US006862954B2

(12) United States Patent
Dubois et al.

(10) Patent No.: US 6,862,954 B2
(45) Date of Patent: Mar. 8, 2005

(54) MOTORIZED JAR OPENER

(75) Inventors: Craig A. Dubois, Trumbull, CT (US); Stephen D. Mowers, Fairfield, CT (US); Tatyana Ekgaus, Trumbull, CT (US); David Robert Arnott, Weston, FL (US); James A. Sandor, Trumbull, CT (US)

(73) Assignee: HP Intellectual Corporation, Wilmington, DE (US)

( * ) Notice: Subject to any disclaimer, the term of this patent is extended or adjusted under 35 U.S.C. 154(b) by 0 days.

(21) Appl. No.: 10/754,808

(22) Filed: Jan. 9, 2004

(65) Prior Publication Data

US 2004/0194580 A1 Oct. 7, 2004

Related U.S. Application Data

(63) Continuation-in-part of application No. 10/039,697, filed on Oct. 26, 2001, now abandoned.

(51) Int. Cl.[7] ..... B67B 7/00
(52) U.S. Cl. ..... 81/3.2; 81/3.32
(58) Field of Search ..... 81/3.2, 3.32, 3.4, 81/3.42

(56) References Cited

U.S. PATENT DOCUMENTS

| | | | | | |
|---|---|---|---|---|---|
| 2,064,381 | A | * | 12/1936 | McColgan | 81/3.32 |
| 2,897,699 | A | * | 8/1959 | Anderson, Jr. | 81/3.32 |
| 3,795,158 | A | | 3/1974 | Morita | |
| 3,812,742 | A | | 5/1974 | Polasek | |
| 3,950,801 | A | | 4/1976 | Morrison | |
| 4,102,226 | A | | 7/1978 | McGuire | |
| 4,171,650 | A | | 10/1979 | Cardinal | |
| 4,762,029 | A | | 8/1988 | Chen | |
| 4,852,431 | A | | 8/1989 | Frangel | |
| D303,343 | S | | 9/1989 | Nuss | |
| 4,919,014 | A | | 4/1990 | Chen et al. | |
| 5,003,844 | A | | 4/1991 | Barrow | |
| 5,022,288 | A | * | 6/1991 | Taktakian | 81/3.4 |
| 5,167,172 | A | | 12/1992 | Heebner | |
| 5,203,236 | A | | 4/1993 | Anderson | |
| 5,271,296 | A | | 12/1993 | Parent et al. | |
| 5,301,433 | A | | 4/1994 | Rogers | |
| 5,329,831 | A | | 7/1994 | Pierce, Jr. et al. | |
| 5,345,844 | A | | 9/1994 | Marsaw | |
| 5,353,665 | A | | 10/1994 | Heebner | |
| 5,617,765 | A | | 4/1997 | Bennett | |
| 5,647,251 | A | | 7/1997 | Hardman | |
| 5,819,508 | A | | 10/1998 | Kraft et al. | |
| 5,996,441 | A | | 12/1999 | Bateman | |
| 6,089,124 | A | | 7/2000 | Murphy | |
| D429,980 | S | | 8/2000 | Warrick | |
| 6,098,497 | A | * | 8/2000 | Larose | 81/3.4 |
| 6,105,468 | A | | 8/2000 | Fohrman et al. | |
| 6,125,718 | A | | 10/2000 | Hill | |
| 6,148,692 | A | | 11/2000 | Russell | |
| 6,182,534 | B1 | | 2/2001 | Hardman | |
| D440,842 | S | | 4/2001 | Vandergaw | |
| 6,293,170 | B1 | * | 9/2001 | Hajianpour | 81/3.2 |

OTHER PUBLICATIONS

Advertisement, Medecos, Inc., "PowerTwist Jar & Bottle Opener," One Page.
University at Buffalo, RERC, 2.0 Introduction, Supply Push Program, Automated Jar Opener.
Inventors' Publishing and Research Online Resources, Hamilton Beach/Proctor Silex "First Electric Jar Opener".
Dynamic Living, Electric Jar and Bottle Lid Opener, "Open Up".

* cited by examiner

*Primary Examiner*—James G. Smith
(74) *Attorney, Agent, or Firm*—Baker Botts L.L.P.

(57) ABSTRACT

A jar opener including a lid clamp adapted to clamp onto a lid of a jar; a motor connected to the lid clamp; and a frame having the motor connected thereto. The frame includes at least three frame sections which are vertically slidingly connected relative to one another in series in a general telescoping fashion. The motor is connected to a top one of the frame sections.

30 Claims, 8 Drawing Sheets

MOTORIZED JAR OPENER

CROSS-REFERENCE TO RELATED APPLICATION

This application is a Continuation-in-Part Patent Application of commonly owned U.S. patent application Ser. No. 10/039,697, filed Oct. 26, 2001, now abandoned, entitled "Motorized Jar Opener," by Craig A. Dubois, et al., which is assigned to the Assignee of the present invention, and which is incorporated by reference herein for all purposes.

BACKGROUND OF THE INVENTION

1. Field of the Invention

The present invention relates to household appliances and, more particularly, to a motorized opener for opening a container having a screw-off removable lid or cap.

2. Prior Art

There have been many products developed over the years that helped people opened jars. These products ranged from rubber pads to help grip the jar to pliers-like tools that grip the lid and gave the user added leverage. All these products were not motorized except for one product with a motor that attached under a cabinet. It used a cone-shaped form with internal ribs to grab the lid. When a user pushed up with the jar into the cone, the upward motion activated a switch and the motor rotated the cone. The person had to hold onto the jar and provide the counter rotational torque.

These existing products have both advantages and disadvantages. Rubber pads can give a user added gripping with slippery lids, but do not provide any extra torque. The mechanical devices that grip provide an advantage with torque by providing a lever arm. However, a disadvantage is that a person still has to provide both the rotational force and counter rotational force. The advantage of the motorized product is that it provided gripping of the lid and rotation, but still did not provide the counter force and a user had to hold the jar up into the cone with some force as the cone rotated the lid.

In addition to the products mentioned above, various other designs have been patented, but have not been commercialized for one reason or another. These patented designs range from totally automated devices to smaller motorized devices. The totally automated devices only need a user to place a jar inside a cabinet, close a door, and press a button. The device does everything. The smaller devices, also motorized, use non slip plates to grab both the lid and base; the motor being located in the base. The plate that grips the lid slides up and down rods that come out of the base. U.S. Pat. No. 3,795,158 discloses a jar lid remover with a lower clamp actuated by a manually rotatable knob and an upper clamp attached to a motor. The lower clamp comprises two slidable jaw members which are slid in and out relative to each other by a rotatable gear. U.S. Pat. Nos. 5,329,831; 5,167,172 and 6,182,534 disclose other type of jar openers.

There is a desire to provide a new type of jar opener which is more user friendly and is more compact to occupy less space on a counter top.

SUMMARY OF THE INVENTION

In accordance with one aspect of the present invention, a jar opener is provided including a lid clamp adapted to clamp onto a lid of a jar; a motor connected to the lid clamp; and a frame having the motor connected thereto. The frame includes at least three frame sections which are vertically slidingly connected relative to one another in series in a general telescoping fashion. The motor is connected to a top one of the frame sections.

In accordance with another aspect of the present invention, a jar opener is provided comprising a lid clamp adapted to clamp onto a lid of a jar; a motor connected to the lid clamp; a frame comprising at least two frame sections vertically slidingly connected to each other; and at least one spring. A top one of the frame sections has the motor connected thereto. The spring is located between portions of the frame sections for biasing the top frame section and the motor in an upward direction.

In accordance with another aspect of the present invention, a jar opener is provided comprising a frame; a motor connected to the frame; a first adjustable clamp connected to the motor; and a second adjustable clamp connected to the frame. The second adjustable clamp comprises a stationary gear and at least two second jaw members having teeth intermeshed with teeth of the stationary gear. The second jaw members are adapted to rotate about the stationary gear to move clamping surfaces of the second jaw members inward and outward relative to the stationary gear.

In accordance with another aspect of the present invention, a jar opener is provided comprising a frame; a motor connected to the frame; and a clamping system connected to the frame and the motor. The clamping system comprising a first jar engagement assembly connected to the motor and a second jar engagement assembly connected to the frame. The second jar engagement assembly comprises generally opposing jaw members adapted to be moved to a clamping position onto a jar by rotational movement of the second jaw assembly, transmitted to the second jaw assembly by the jar, while the jar is rotated on the second jaw assembly.

In accordance with one method of the present invention, a method for opening a jar in a motorized jar opening apparatus is provided comprising steps of rotating the jar; and automatically closing a jar clamp onto the jar as the jar is rotated, the step of automatically closing comprising the jar clamp being axially rotated by contact with the rotating jar to move clamping surfaces of jaw members of the jaw clamp inward towards each other.

In accordance with another method of the present invention, a method for opening a jar in a motorized jar opening apparatus is provided comprising steps of rotating a first jar engagement assembly by a motor while the jar remains relatively stationary, the first jar engagement assembly being located against a first portion of the jar; closing the first jar engagement assembly onto the first portion of the jar as the first jar engagement assembly is rotated relative to the first portion; subsequently rotating the first jar engagement assembly and the jar together as a unit; and automatically moving a second jar engagement assembly from an open position to a closed position onto a second portion of the jar as the jar is rotated, the second jar engagement assembly being located against the second portion and being moved to the closed position by rotation of the jar.

BRIEF DESCRIPTION OF THE DRAWINGS

The foregoing aspects and other features of the present invention are explained following description, taken in connection with the accompanying drawings, wherein.

DETAILED DESCRIPTION OF THE PREFERRED EMBODIMENT

Figure 1:
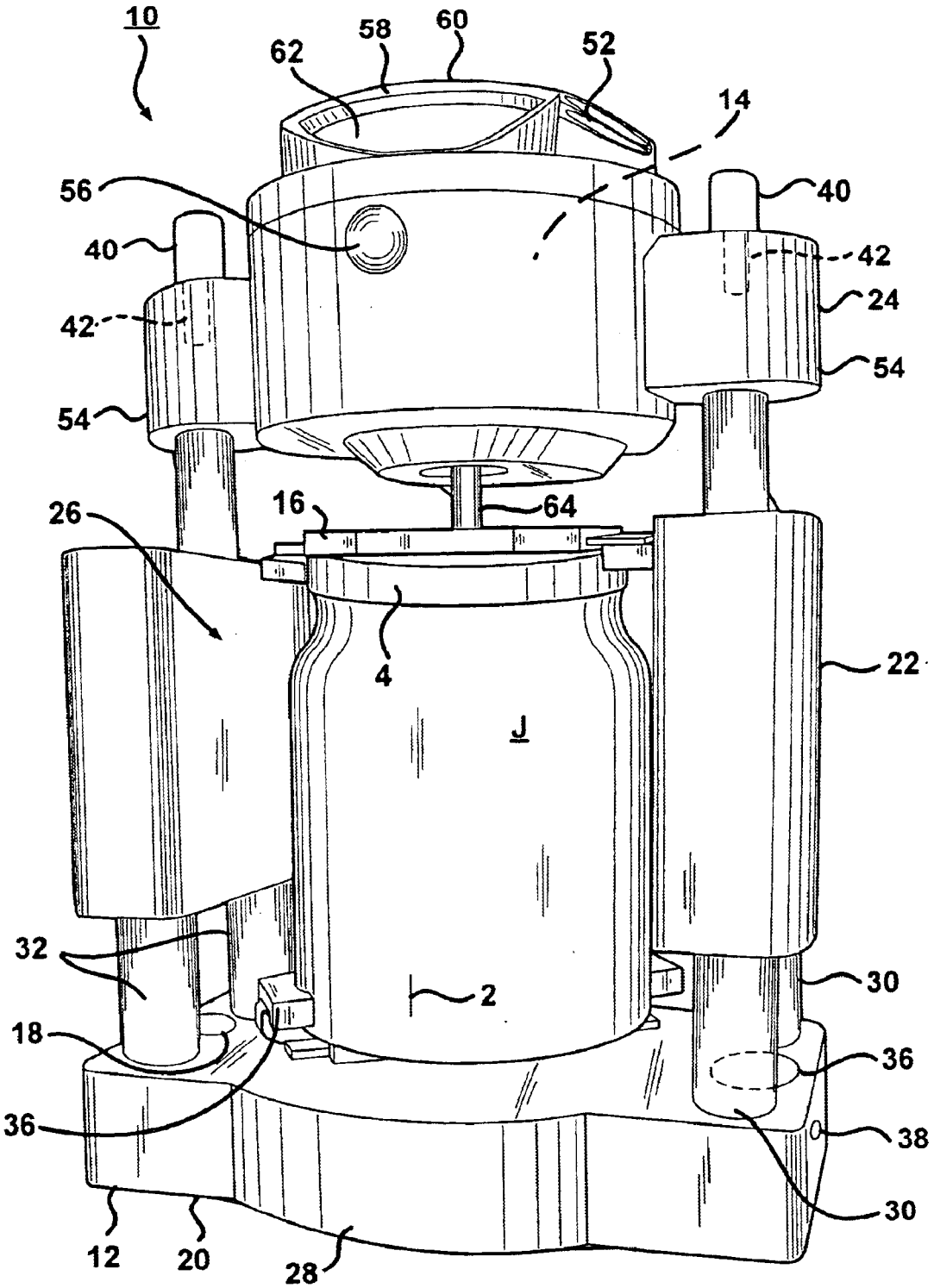
FIG. 1 is a perspective view of a jar located in an opener incorporating features of the present invention.

Referring to FIG. 1, there is shown a perspective view of an opener 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The opener 10 is shown with a jar J located therein. The jar J generally comprises a container or jar base 2 and a lid 4. The jar base 2 could be comprised of glass or any other suitable type of material. The lid 4 is preferably comprised of metal or plastic, but any other suitable type of material(s) is used. The lid 4 is removably connected to the top of the jar base 2 by a threaded connection. Thus, the lid 4 is adapted to be unscrewed from the jar base 2, and perhaps re-screwed onto the top of the jar base. Many different types jars are well known in the art. For example, there is a bayonet style jar/lid connection, which is also under a vacuum, that is also suitable for opening by use of the present invention. The opener 10 is adapted to open the jar J by unscrewing the lid 4 from the jar base 2.

The opener 10 generally comprises a frame 12, a motor 14, a lid clamp 16, and a jar base clamp 18. The frame 12 generally comprises three sections 20, 22, 24 which are vertically slidingly connected relative to one another in series in a general telescoping fashion. In an alternate embodiment, the frame could comprise more or less than three sections. In addition, in another alternate embodiment, any suitable type of movable connection among the frame sections could be provided. The movable connection among the three frame sections 20, 22, 24 is adapted to allow the frame to be opened and closed among the positions shown in FIGS. 2, 6, 7 in order to insert, engage, and remove the jar J from the jar receiving area 26 of the opener 10.

Figure 2:
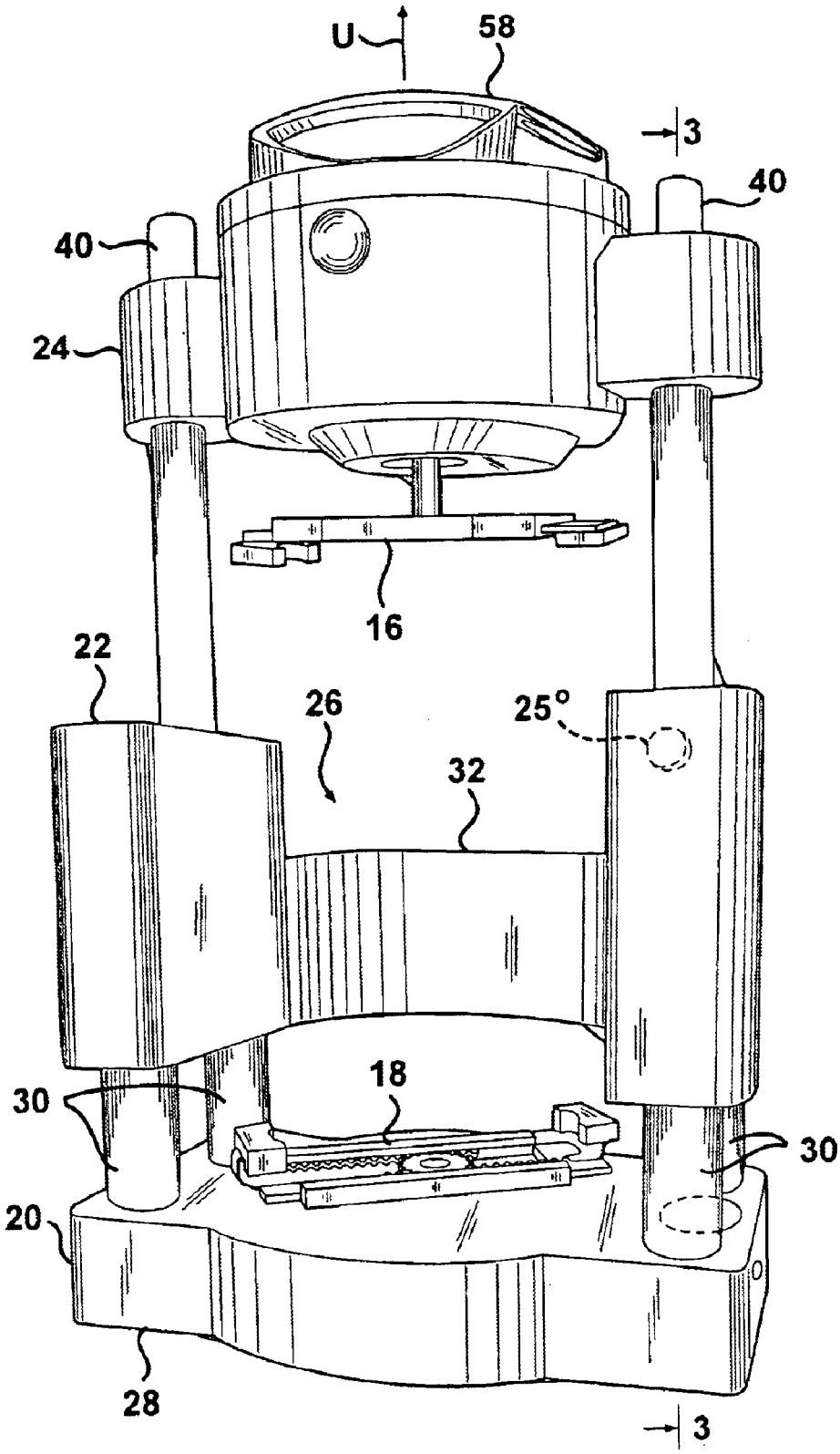
FIG. 2 is a perspective view of the opener shown in FIG. 1 at a fully extended position.
Figure 3:
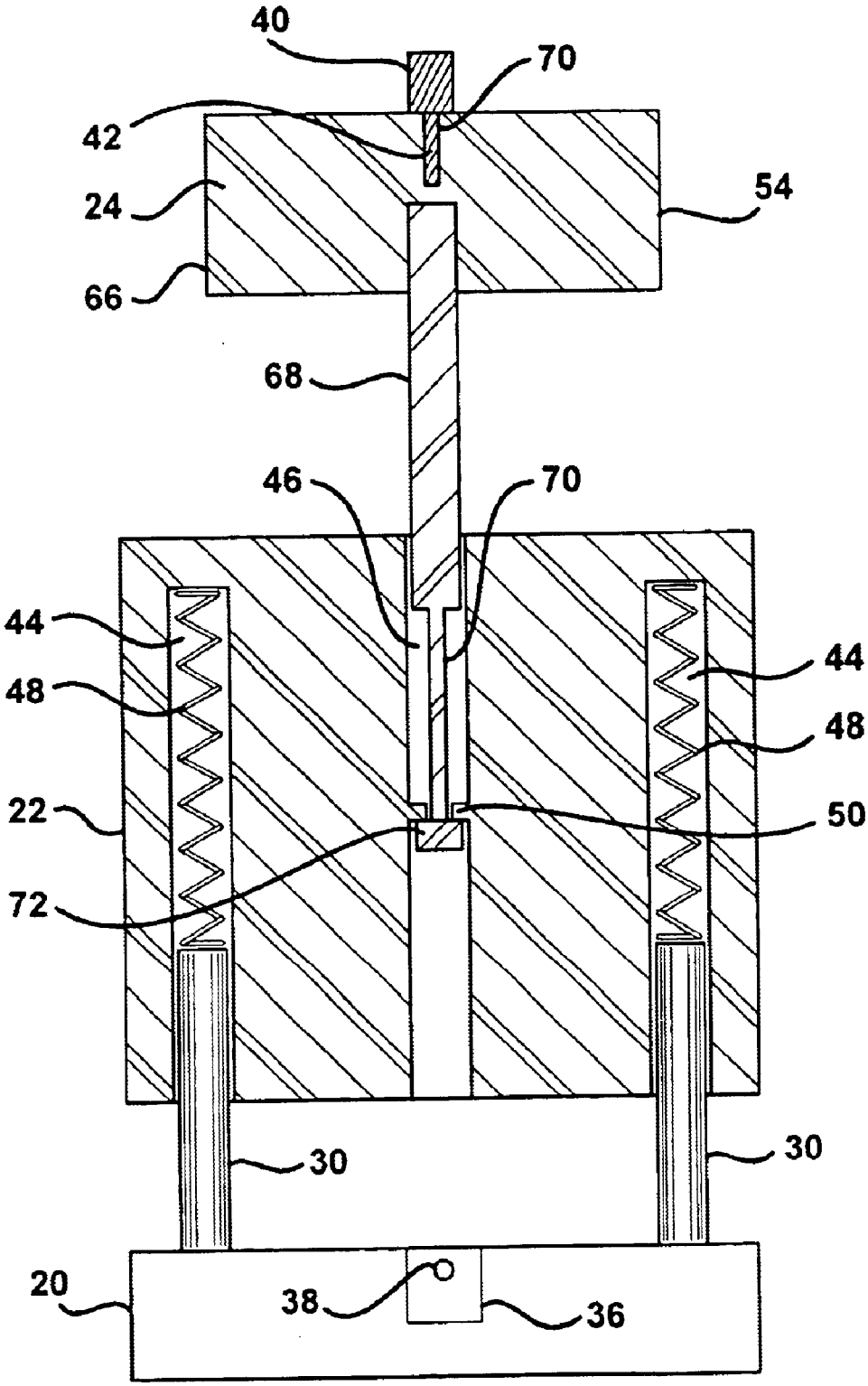
FIG. 3 is a cross sectional view of one portion of the opener shown in FIG. 2.

Referring also to FIGS. 2 and 3, the first frame section 20 generally comprises a bottom frame section adapted to stablely locate the opener 10 on a flat surface, such as a kitchen counter top surface. The bottom frame section 20 generally comprises a base 28 and upwardly extending posts 30. In the frame embodiment shown, the bottom frame section 20 comprises four of the upwardly extending posts 30; two on each lateral side of the base 28. However, in alternate embodiments, the bottom frame section 20 could comprise more or less then four posts. Additionally, the posts could be located at any suitable position on the base 28.

In the embodiment 20 shown, the bottom frame section 20 comprises two holes 36 located between the pairs of posts 30 on each lateral side. The bottom frame section 20 also comprises holes 38 which extend laterally inward from the lateral exterior sides of the bottom frame section 20 and intersect with the holes 36. The opener 10 comprises latching pins 40. The latching pins 40 are shown in FIG. 1 attached to the top frame section 24 while not in use. The latching pins 40 each include a pin section 42. The latching pins 40 can be removed from the top frame section 24 and the pin sections 42 are sized and shaped to be inserted into the holes 38. When inserted into the holes 38, the pin sections 42 can project into the holes 36. In an alternate embodiment, a release latch in the lower front base 20 will preferably be used.

The second frame section 22 is slidingly connected to the posts 30 to move up and down on the posts 30. The second frame section 22 forms a middle frame section of the frame 12. The second frame section 22 generally comprises a general horizontally orientated U-shaped member. The middle frame section 22 comprises a curved back fence section 32 and two leg sections 34 to form the general U-shape. However, in alternate embodiments, the second frame section 22 could have any suitable type of shape. For example, the back of the second frame section 22 could be open without a back fence section. The curved back section 32 forms a rear wall for the jar receiving area 26. However, in alternate embodiments, any suitable type of rear side boundary could be provided. In an alternate embodiment, a rear side boundary might not be provided.

The two legs sections 34 are each slidably mounted on the two of the posts 30; one leg section 34 on each lateral side of the base section 20. Each leg section 34 generally comprises two post holes 44 and a center hole 46. The two post holes 44 are sized and shaped to slidingly receive the posts 30 therein. The posts 30 extend into the bottom ends of the holes 44. The top ends of the holes 44 are closed. Springs 48 are provided in the holes 44.

The springs 48 are located between the top ends of the posts 30 and the closed top ends of the holes 44. The springs 48 are adapted to bias the middle frame section 22 in an upward direction relative to the bottom frame section 20. However, the springs 48 can be compressed to move the middle frame section 22 downward on the posts 30. In alternate embodiments, any suitable type of means for biasing the middle frame section in an upward direction relative to the bottom frame section could be provided. Alternatively, the center hole 46 comprises a stop limiter ledge 50. The center hole 46 extends completely through the middle frame section 22 between its top side and its bottom side.

The third frame section 24 is slidingly connected to the middle frame section 22 at the center holes 46. The third frame section 24 forms a top frame section of the frame 12. The top frame section 24 generally comprises a center section 52 and two lateral side sections 54. The center section 52 forms a housing for the motor 14. In the embodiment shown, the opener 10 comprises a push button actuator 56 connected to the top frame section 24 in order for a user to actuate the motor 14. The actuator 56 could comprise a momentary switch, such that the user has full control over the unit. However, in an alternate embodiment, any suitable type of actuator could be provided. Also in the embodiment shown, the top frame section 24 comprises a handle 58.

The handle 58 comprises a top section 60 and a center hole 62. The center hole 62 is sized and shaped to allow a user's hand to be inserted into the hole with the user's palm facing downward. The top section 60 is adapted to contact the backhand side of a user's hand. Thus, the user can push downward on the top frame section 24 at the bottom section of the hole 62 with the user's palm. In addition, the user can lift the top frame section 24 in an upward direction with contact between the backhand of the user's hand and the top section 60. A drive shaft 64 from the motor 14 extends downward from a bottom side of the top frame section 24. In a preferred embodiment, a reduction gear assembly is provided between the motor and the drive shaft 64.

The lateral side sections 54 each generally comprises a main section 66 and a downwardly extending post 68. The main section 66 comprises a hole 70. The hole 70 is adapted to receive the pins section 42 of the latching pin 40. The hole 70 and the top surface of the main section 66 form a temporary storage area for the latching pins 40.

The posts 68 are fixedly attached to the main sections of 66 and extended in a general downward direction. The posts 68 are sized and shaped to be slidingly mounted in the center holes 46 of the middle frame sections 22. The bottom ends of each post 68 comprises an annular groove or recess 70 and an enlarged bottom 72. The top side of the enlarged bottom 72 forms a latching surface. As noted above, the center holes 46 each comprise a stop limiter ledge 50. The stop limiter ledge 50 is located in the recess 70 of the post 68. The stop limiter ledge 50 can be engaged by the enlarged bottom 72 to prevent withdrawal of the top frame section 24 from the middle frame section 22. However, in alternate embodiments, any suitable connection between the top frame section and the middle frame section could be provided. In one type of alternate embodiment, the frame could comprise a detent latching system 250 (see FIG. 2) to hold the upper frame section 24 in its fully opened upright position. Any suitable detent latching system could be provided, such as a spring loaded push button detent. This could be useful for a user who desires to use two hands to raise the third frame section and/or two hands to load the jar into the opener, or for a user who has only one hand.

Figure 4:
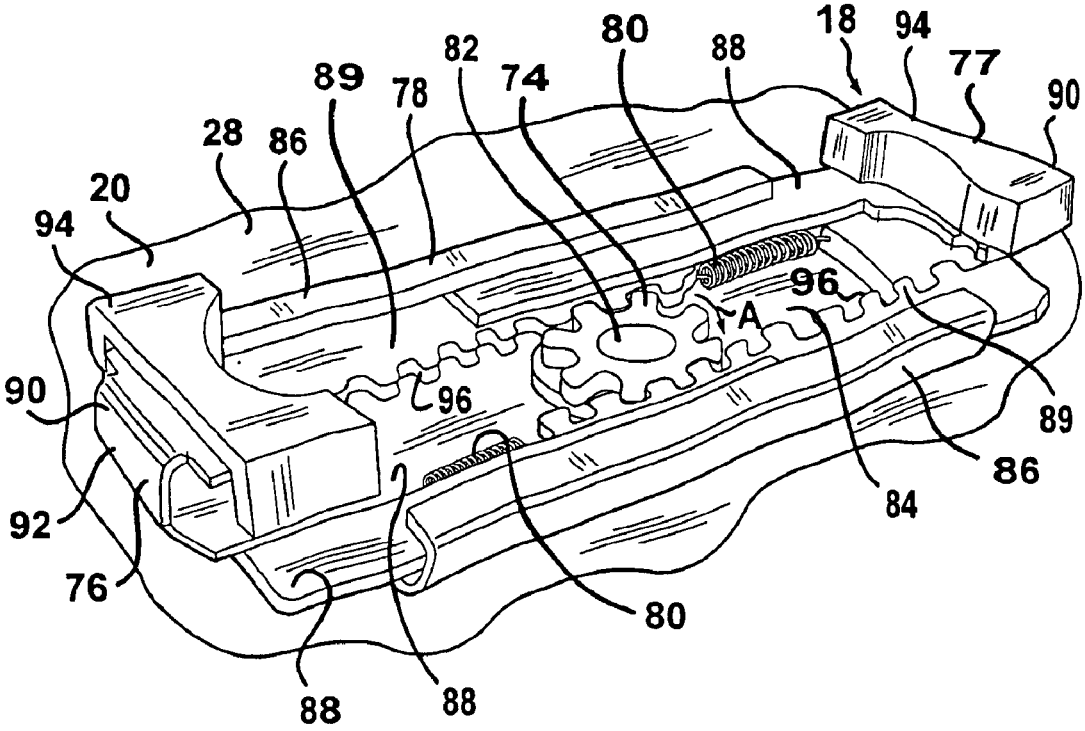
FIG. 4 is a partial perspective view of the bottom adjustable jar clamp.

Referring now to FIG. 4, a perspective view of the jar base clamp 18 is shown. The jar base clamp 18 generally comprises a stationary gear 74, two jaw members 76, 77, a guide 78, and springs 80. In the embodiment shown, the jar base clamp 18 is shown located above the top surface of the base 28. However, in an alternate embodiment, the base 28 could comprise a recess with the top side of the guide 78 being located generally flush with the top side of the base 28. The stationary gear 74 is fixedly and stationarily connected to the base 28 of the bottom frame section 20 by a shaft 82. The guide 78 is rotatably connected the stationary shaft 82. The guide 78 generally comprises a bottom section 84 and two general C shaped side sections 86. The bottom section 84 comprises a hole which the shaft 82 extends through. The general C shaped side sections 86 form inwardly facing grooves for portions of the jaw members 76, 77 to slide in.

The two jaw members 76, 77 are substantially identical to each other, but merely orientated in opposite directions. However, in alternate embodiments, the two jaw members could be different from each other. In addition, more than two movable jaw members could be provided. Each jaw member generally comprises two legs 88, 89 and an outward section 90. The outward section 90 connects the two legs 88, 89 to each other. The outward section 90 generally comprises an elevation section 92 and a friction grip 94

The elevation section 92 merely functions to elevate the friction gripping member 94 above the top surface of the guide 78. The friction grip members 94 are preferably comprised of resilient polymer material. However, in alternate embodiments, the friction grip members 94 could be comprised of any suitable type of materials. In the embodiment shown, the friction crimping members 94 have inward facing surfaces which are slightly contoured for engaging a curved surface of the jar base 2 and providing more contact surface area between the friction gripping members 94 and the jar base 2.

The first leg 88 is substantially flat and has a general elongated length. The second leg 89 also has a general elongated length. However, the second leg 89 comprises teeth 96 along its inward facing side. The teeth 96 are aligned in a straight elongated row. The teeth 96 are intermeshed with the teeth of the stationary gear 74. The teeth 96 of the first jaw member 76 are located on an opposite side of the stationary gear 74 from the teeth of the second jaw member 77.

The two jaw members 76, 77 are located in overlapping positions relative to each other. More specifically, the first leg 88 of each jaw member is located in a plane above the second leg 89 of the same jaw member. With the two jaw members 76, 77 located opposite each other, the first legs 88 are positioned on top of the second legs 89 of the opposite jaw member. This allows the first leg 88 of the first one of the jaw members to slide relative to the second leg 89 of the other jaw member in an overlapping relationship. The overlapping pairs of legs 88, 89 are located in the grooves of the C shaped side sections 86 of the guide 78. Thus, the jaw members 76, 77 can longitudinally slide in and out relative to each other at the opposite ends of the guide 78.

As noted above, the gear 74 is a stationary gear. The gear 74 does not move relative to the base 28. Instead, the assembly of the guide 78 and two jaw members 76, 77 is adapted to rotate about the gear 74. As the assembly rotates about the gear 74, the teeth 96 of the jaw members 76, 77 are walked along the teeth of the stationary gear 74. This causes the jaw members 76, 77 to be moved inward or outward relative to the guide 78 as the assembly is rotated about the stationary gear. In an alternate embodiment, any suitable type of system to clamp or grasp the jar base could be provided. For example, in an alternate embodiment, the opener could the comprise a motor connected to the gear 74 for rotating the gear and the guide 78 could be stationarily connected to the base 28.

In the embodiment shown, if the assembly is rotated in a clockwise direction A (looking downward) relative to the gear 74, the friction gripping members 94 are moved in an inward direction towards each other. This counterclockwise rotation of the assembly on the base 28 can occur by the jar J being placed on the guide 78 and rotated in a clockwise direction. Frictional engagement between the bottom of the jar J and the guide 78 causes the assembly to rotate with the jar J. The movement of the friction gripping members 94 in an inward direction towards each other results in the bottom section of the jar base 2 being clamped between the friction gripping members 94. As the jar base 2 becomes clamped between the friction gripping members 94, the jaw members 76, 77 are prevented from further inward movement by the jar base 2 blocking this further inward movement. Thus, the assembly stops rotating on the stationary gear 74. This creates a stationary holding of the jar J on the bottom frame section 20.

If the assembly is rotated in a counterclockwise direction relative to the gear 74, the friction gripping members 94 are moved in an outward direction away from each other. This can result in disengaging the gripping engagement of the friction gripping members 94 from the jar base 2, or opening the distance between the friction gripping members 94 to allow insertion of the jar base 2 between the two gripping members 94. Rotation of the assembly in the counterclockwise direction can be accomplished by merely rotating the jar base 2 in a counterclockwise direction; the frictional engagement between the jar base and the guide 78 rotating the guide and jaw members counterclockwise.

As noted above, in the embodiment shown, the jar base clamp 18 comprises two springs 80. In alternate embodiments, the springs 80 might not be provided. Alternatively, any suitable means for biasing the jaw members towards or away from each other could be provided. In the embodiment shown, the two springs 80 are coil springs located between portions of the two jaw members 76, 77. The springs 80 bias the two jaw members away from each other in outward directions. Thus, the jar base clamp 18 comprises a home position with the two jaw members 76, 77 located in outward positions relative to each other. When a jar is located on the guide 78 and rotated in a clockwise direction, the springs 80 are compressed as the jaw members 76, 77 move in inward directions. When the jar base 2 is removed from the jar base clamp 18 the springs 80 push the jaw members 76, 77 in outward directions to return the jaw members to their home positions. In an alternate embodiment, the springs 80 are not provided. Instead, the lower jaw assembly is manually moved to an open position.

Figure 5:
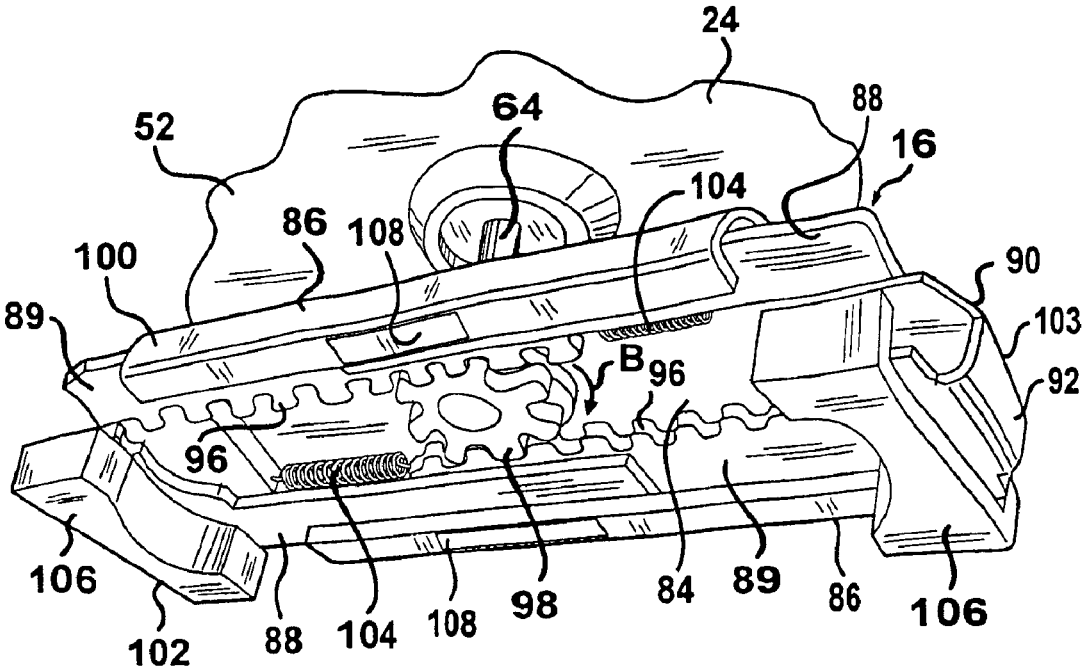
FIG. 5 is partial perspective view the of the top adjustable lid clamp.

Referring now also to FIG. 5, a perspective view of the lid clamp 16 is shown. The lid clamp 16 is very similar to the jar base clamp 18. However, in alternate embodiments, the two clamps could be very different. In the embodiment shown, the lid clamp 16 generally comprises a rotatable gear 98, two jaw members 102, 103, a guide 100, and springs 104. The gear 98 is connected to the motor 14 by the shaft 64. The guide 100 is rotatably connected to the shaft 64. The guide 100, in the embodiment shown, is substantially identical to the guide 78 of the jar base clamp 18. However, in alternate embodiments, the two guides could be different. The guide 100 generally comprises a top section 84 and two general C shaped side sections 86. The top section 84 comprises a hole which the shaft 64 extends through. The general C shaped side sections 86 form inwardly facing grooves for portions of the jaw members 102, 103 to slide in.

The two jaw members 102, 103 are substantially identical to each other, but merely orientated in opposite directions. However, in alternate embodiments, the two jaw members could be different from each other. In addition, more than two movable jaw members could be provided. The jaw members 102, 103 are substantially similar to the jaw members 76, 77. However, in a preferred embodiment, the friction gripping members 94 of the jar base clamp 18 have a longer height then the friction gripping members 106 of the lid clamp 16. Each jaw member 102, 103 generally comprises two legs 88, 89 and an outward section 90. The outward section 90 connects the two legs 88, 89 to each other. The outward section 90 generally comprises an elevation section 92 and a friction grip member 106.

The friction gripping members 106 are preferably comprised of resilience polymer material. However, in alternate embodiments, the friction grip members could be comprised of any suitable type of materials. In the embodiment shown, the friction gripping members 106 have inward facing surfaces which are slightly contoured for engaging a curved surface of the jar lid 4 and providing more contact surface area between the friction gripping members 106 and the jar lid 4.

The teeth 96 of the first legs 88 of the two jaw members 102, 103 of the lid clamp 16 are intermeshed with the teeth of the rotatable gear 98. The teeth 96 of the first jaw member 102 are located on an opposite side of the rotatable gear 98 from the teeth of the second jaw member 103.

The two jaw members 102, 103 are located in overlapping positions relative to each other. More specifically, the first leg 88 of each jaw member is located in a plane below the second leg 89 of the same jaw member. With the two jaw members 102, 103 located opposite each other, the first legs 88 are positioned below the second legs 89 of the opposite jaw member. This allows the first leg 88 of the first one of the jaw members to slide relative to the second leg 89 of the other jaw member in an overlapping relationship. The overlapping pairs of legs 88, 89 are located in the grooves of the C shaped side sections 86 of the guide 100. Thus, the jaw members 102, 103 can longitudinally slide in and out relative to each other at the opposite ends of the guide 78. The springs 104 are shown as being coil springs, but in an alternate embodiment, the springs 104 are preferably torsion springs. The springs 104 are preferably adapted to automatically open the upper jaw assembly when the switch 56 is released.

The assembly of the guide 100 and the jaw members 102, 103 is adapted to rotate with the gear 98 and, is also adapted to rotate about the gear 98. When the gear 98 is rotated relative to the guide 100 by the motor 14 and shaft 64, the teeth of the gear 98 move the legs 89 of the jaw members 102, 103 to slide in the guide 100. This causes the jaw members 102, 103 to be moved inward or outward relative to guide 100. In an alternate embodiment, any suitable type of system to clamp or grasp the jar lid could provided. For example, in an alternate embodiment, the lid clamp could have a stationary gear, such as when the motor is connected to the jar base clamp.

In the embodiment shown, if the gear 98 is rotated in a clockwise direction B (looking upward) relative to the guide 100, the friction gripping members 106 are moved in an inward direction towards each other. The movement of the friction gripping members 106 in an inward direction towards each other results in the lid 4 being clamped between the friction gripping members 106.

As the jar lid 4 becomes clamped between the friction gripping members 106, the jaw members 102, 103 are prevented from further inward movement by the jar lid 4 blocking this further inward movement. Thus, the assembly of the guide 100 and jaw members 102, 103 then start to rotate with the rotating gear 98 in the clockwise direction B. This imparts a clockwise rotational force on the jar lid 4. The entire jar J is then rotated in a clockwise direction until the jar base clamp 18 stops the jar base 2 from rotating. When the jar base clamp 18 and jar base 2 stop rotating, the motor 14 continues to rotate the lid clamp 16 relative to the jar base 2 and, thus, rotates the jar lid 4 relative to the jar base 2. This results in the jar lid 4 being unscrewed off of the top of the jar base 2.

If the assembly 100, 102, 103 is rotated in a counterclockwise direction, the friction gripping members 106 are moved in an outward direction away from each other. This can result in disengaging the gripping engagement of the friction gripping members 106 from the jar lid 4, or opening the distance between the friction gripping members 106 to allow insertion or removal of the jar lid 4 between the two gripping members 106.

As noted above, in the embodiment shown, the lid clamp 16 comprises two springs 80. In alternate embodiments, the springs 80 might not be provided. Alternatively, any suitable means for biasing the jaw members towards or away from each other could be provided. For example, in an alternate embodiment, a single spring (such as a torsion spring) could be provided with the shaft assembly and connected to the clamp assembly housing. In the embodiment shown, the two springs 80 are coil springs located between portions of the two jaw members 102, 103. The springs 80 bias the two jaw members away from each other in outward directions. Thus, the lid clamp 16 comprises a home position with the two jaw members 102, 103 located in outward positions relative to each other. When the lid clamp 16 is rotated relative to the lid 4, with the lid 4 providing a slight frictional force to the guide 100, the springs 80 are compressed as the jaw members 102, 103 move in inward directions. When the lid clamp 16 is disengaged from the lid 4, the springs 80 push the jaw members 102, 103 in outward directions to return the jaw members to their home positions. In a preferred embodiment, the lid clamp 16 comprises magnets 108 on the guide 100 to retain a metal lid with the guide 100 when the lid 4 and jar base 2 are moved away from each other. However, in an alternate embodiment, the magnets might not be provided, or any suitable lid retainment system could be provided. In a preferred embodiment, a frictional material is used on the clamp assemblies 16, 18 to make initial contact with the lid and the jar.

Figure 6:
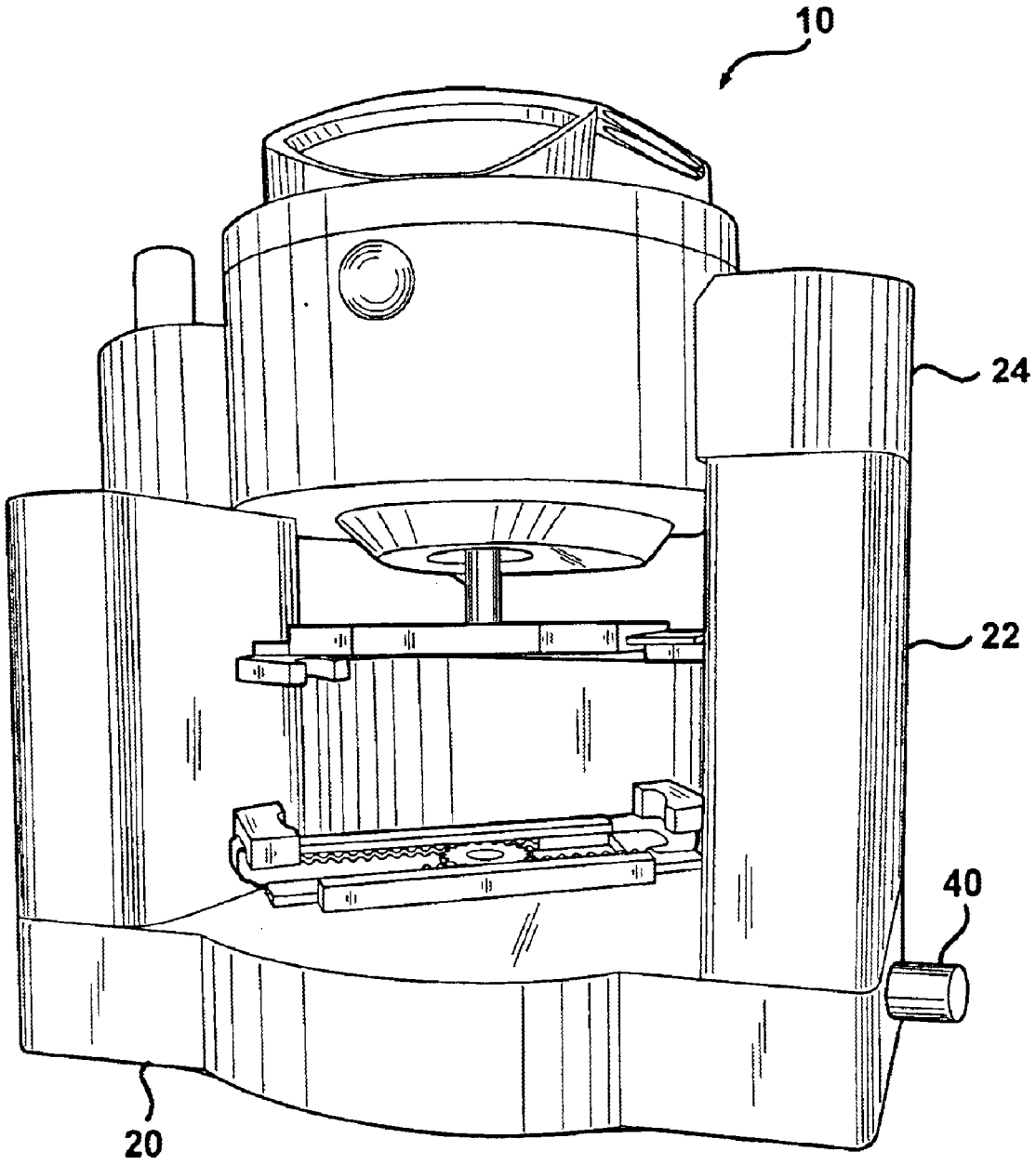
FIG. 6 is a perspective view of the opener at a closed storage position.

Referring now to FIGS. 6, 2 and 1, various different configurations or positions of the frame 12 of the opener 10 are shown. FIG. 6 shows the frame 12 in a collapsed storage position. In this position, the three frame sections 20, 22 and 24 have been telescopingly collapsed to reduce the height of the opener. In this compacted position, the bottom ends of the downward extending posts 68 of the top frame section 24 (see FIG. 3) extend into the holes 36 of the bottom frame section 20. The springs 48 are compressed. The latching pins 40 have been moved from their storage positions on the top frame section 24 and have been inserted into the holes 38. The latching pins 40 function to lock the three frame sections in their stored position. The pin sections 42 of the latching pins project into the recesses 70 of the posts 68 above the enlarged bottom 72. This prevents the springs 48 from moving the middle frame section 22 upward away from the bottom frame section 20. In an alternate embodiment, the latching pins 40 could be replaced by an automatic latching system which automatically latches the frame sections 20, 22, 24 in their stored configuration when a user moves the top frame section 24 fully downward. In this automatic latching system embodiment, a latch release, such as a push button, could be provided to release the automatic latching system.

Figure 7:
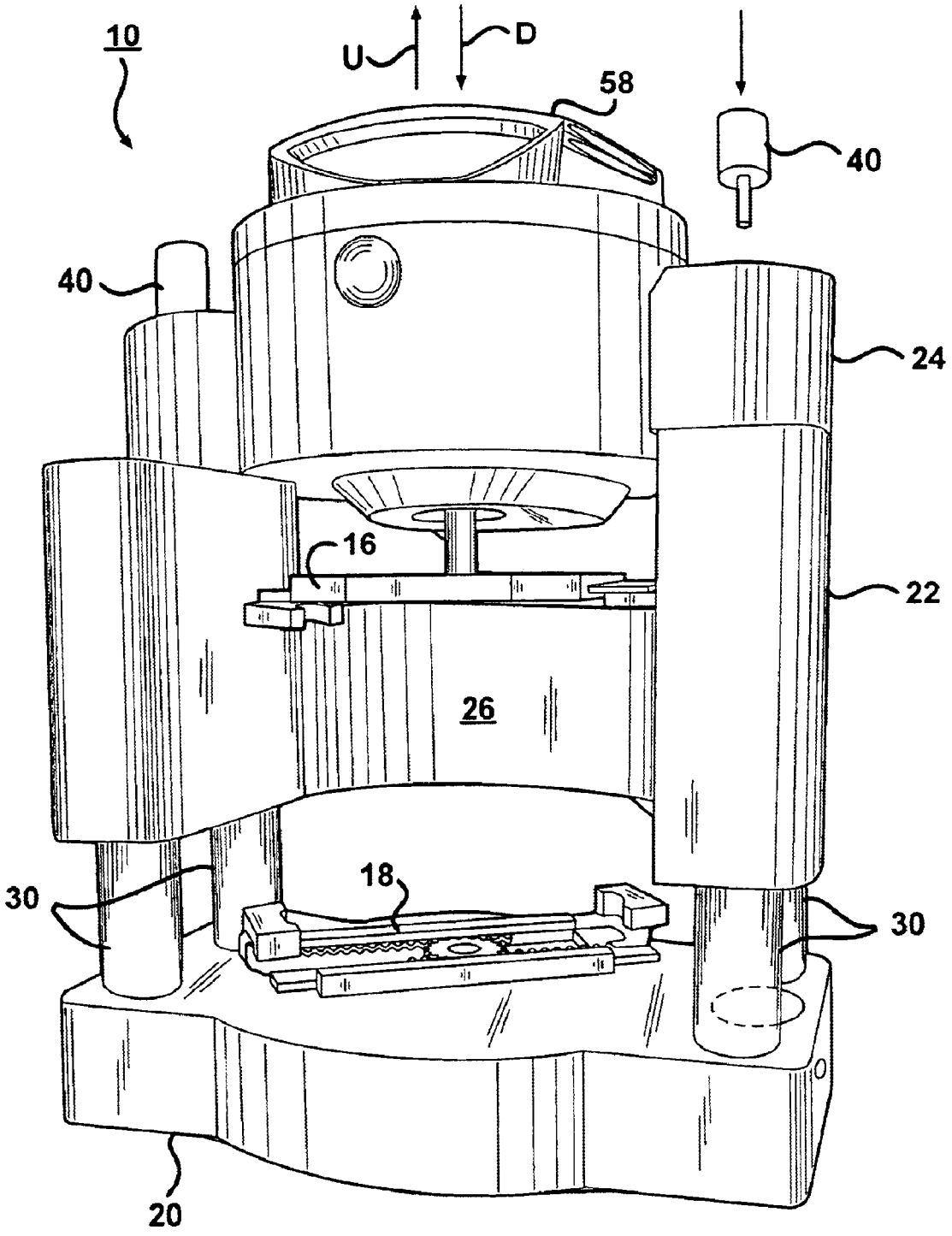
FIG. 7 is a perspective view of the opener shown in FIG. 6 at a partially extended position.

When a user desires to use the opener 10, the user can merely remove the latching pins 40 from the bottom frame section 20. The springs 48 then automatically move the middle frame section 22 upward into the position as shown in FIG. 7. The spring load provided by the springs help to position the jaw assemblies at a predetermined height relative to each other. As the middle frame section 22 slides upward on the posts 30 the top frame section 24 is also moved upward. Thus, the lid clamp 16 is moved upward away from the jar base clamp 18 to open or enlarge the jar receiving area 26. The latching pins 40 can be stored on top of the top frame section 24 until they are needed again. The top frame section 24 is still located directly against the middle frame section in 22 in a downward position by gravity. However, the top frame section can be moved upward relative to the middle frame section 22 by a user pulling upward on the top frame section 24.

In the event the jar desired to be opened is smaller in height than the distance between the clamps 16, 18 when the opener is in the position shown in FIG. 7, a user can merely exert a downward force D at the handle 58 to move the top frame section 24 downward until the lid clamp 16 contacts the jar's lid. The middle frame section 22 is moved downward with the top frame section 24 and the springs 48 are compressed. After the lid is unscrewed from the jar base, the user can stop exerting the force D and the springs 48 can move the frame sections 22, 24 upward to move the lid clamp 16 and lid away from the jar base.

In the event the jar desired to be opened is larger in height then the distance between the clamps 16, 18 when the opener is in the position shown in FIG. 7, a user can merely exert an upward force at the handle 58 to move the top frame section 24 upward, thereby enlarging the jar receiving area 26. FIG. 2 shows the maximum height between the two clamps 16, 18 when the top frame section 24 is moved to its upper most position. Once the jar is located on the jar base clamp 18, the user can lower the top frame section 24. This is relatively easy to do, because of the weight of the motor 14 inside the top frame section 24. Once the lid clamp 16 is located on the jar's lid 4 the weight of the third frame section 24 and motor 14 applies a downward force by the lid clamp 16 against the jar lid. With the weight of the motor in the upper frame section, downward force by a user should not be needed. If additional downward force is needed, the weight of the motor in the third frame section 24 reduces the amount of downward force on the top frame section 24 which the user needs to apply in order to provide sufficient frictional forces between the jar and the guides 78, 100. The three telescoping sections 20, 22, 24 provide an increased range of jar heights which can be accommodated.

With embodiment described above, the unit can be powered by a motor that turns an upper jaw assembly which rests against the top of the lid of the jar. The upper jaw assembly starts to turn the jaws inward towards the lid. This can be accomplished by the weight of the unit (above the jar) and the friction applied by the jaw assembly (such as rubber or another material). Once the jaws grip the lid, the entire jar starts to spin on the lower jaw assembly. The bottom jaws clamped the jar just like the upper jaw assembly. Once the bottom of the jar is gripped, the jar stop spinning. A torque is then applied to the lid by the motor and the upper jaw assembly, and the lid is unscrewed.

In one preferred method of the present invention, once the jar has been located between the two clamps 16, 18, the user then actuates the momentary switch 56. The top jaws of the lid clamp 16 then close onto the lid 4. This then causes the entire jar J to be rotated with the lid clamp 16. The jar base clamp 18 rotates with the jar base 2. The bottom jaws of the jar base clamp 18 close onto the jar base 2. The jar base clamp 18 stops rotating when the clamp 18 fully clamps onto the jar base 2. The lid clamp 16 continues to rotate. The lid clamp 16 then rotates the lid 4 relative to the base 2 to unscrew the lid from the base. When the lid is unscrewed from the jar base, the force on the jar is released and the lid spins freely with the upper clamp assembly. The jar becomes stationary. When the user released the switch 56, the upper clamp assembly returns to the open position by the biasing action of the spring(s) 104 and, thus, releases the lid from the upper clamp assembly. One unique feature of the embodiment described above is that the closure of the jar base clamp 18 onto the jar base 2 is driven by the motor 14 through rotation of the jar base 2 through the lid 4 and lid clamp 16.

Figure 8:
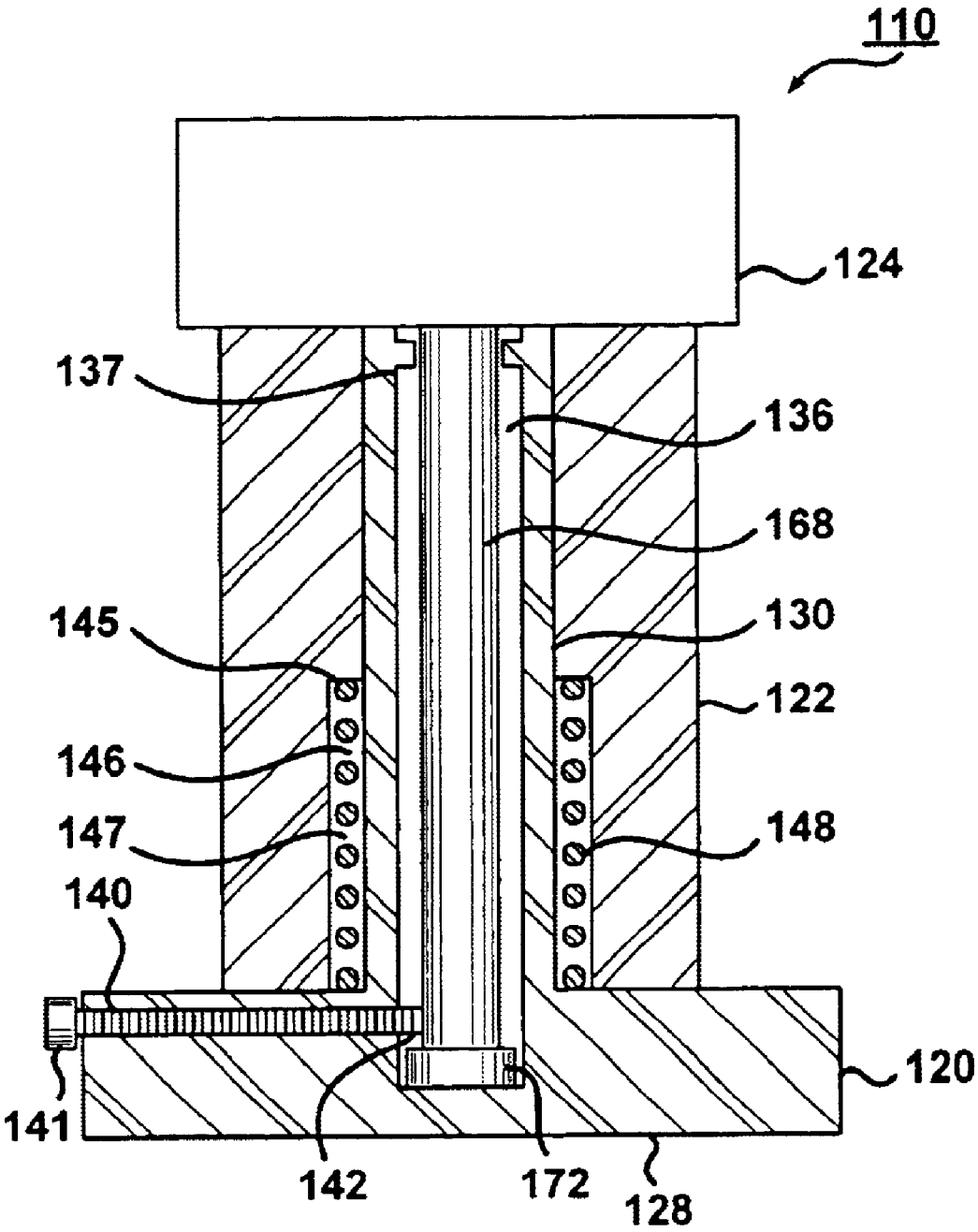
FIG. 8 is a cross sectional view of an alternate embodiment of the present invention.

Referring now to FIG. 8, an alternate embodiment of the present invention is shown. FIG. 8 shows a cross sectional view of one lateral side of the opener 110 similar to the cross sectional view shown in FIG. 3. In this embodiment the opener 110 comprises a frame having three frame sections 120, 122, 124. The bottom frame section 120 comprises a base 128 and a single post 130 at each lateral side of the base. The posts 130 each comprise a hole 136 extending downward from a top open side of the post 130. Each post 130 comprises a stop limiter 137 in the hole 136 at the top end of the hole. The hole 136 extends the entire length of the post 130 and into a portion of the base when 28.

The first frame section 120 also comprises a movable latch 140. The latch 140 is slidably connected to the base 128. A user contact area 141 extends from the front face of the base 128. An opposite end 142 of the movable latch 140 is movable into and out of the hole 136. The end 142 is adapted to be located above an enlarged bottom 172 of the post 168 to latch the top frame section 124 in a down stored position. In an alternate embodiment, any suitable type of latching system could be provided.

The middle frame section 122 is vertically slidable on the posts 130. The opposite lateral sides of the middle frame section 122 each comprise a center hole 146. In this embodiment, each center hole 146 comprises an enlarged area 147 at its bottom. The spring 148 is located in the enlarged area 147. In this embodiment, the spring 148 is a coil spring which is coaxially aligned around the post 130. However, in alternate embodiments, any suitable type of spring or connection of the spring to the frame could be provided. In the compacted, storage position shown in FIG. 8, the spring 148 is compressed between the top side of the base 128 and a ledge 145.

The top frame section 124 comprises the downwardly extending posts 168. Each post 168 is slidable up and down inside the hole 136 of the post 130. The two posts 130, 168 are coaxially aligned with each other. The two holes 136, 146 are also coaxially aligned with each are other. This embodiment illustrates that the opener might comprise less than four posts 30 as shown in FIG. 1, and that the movable connection among the frame sections can have various different types of embodiments. For example, in another alternate embodiment, the top frame section and the bottom frame section could be connected to each other by a single movable connection at the rear side of the opener.

Figure 9:
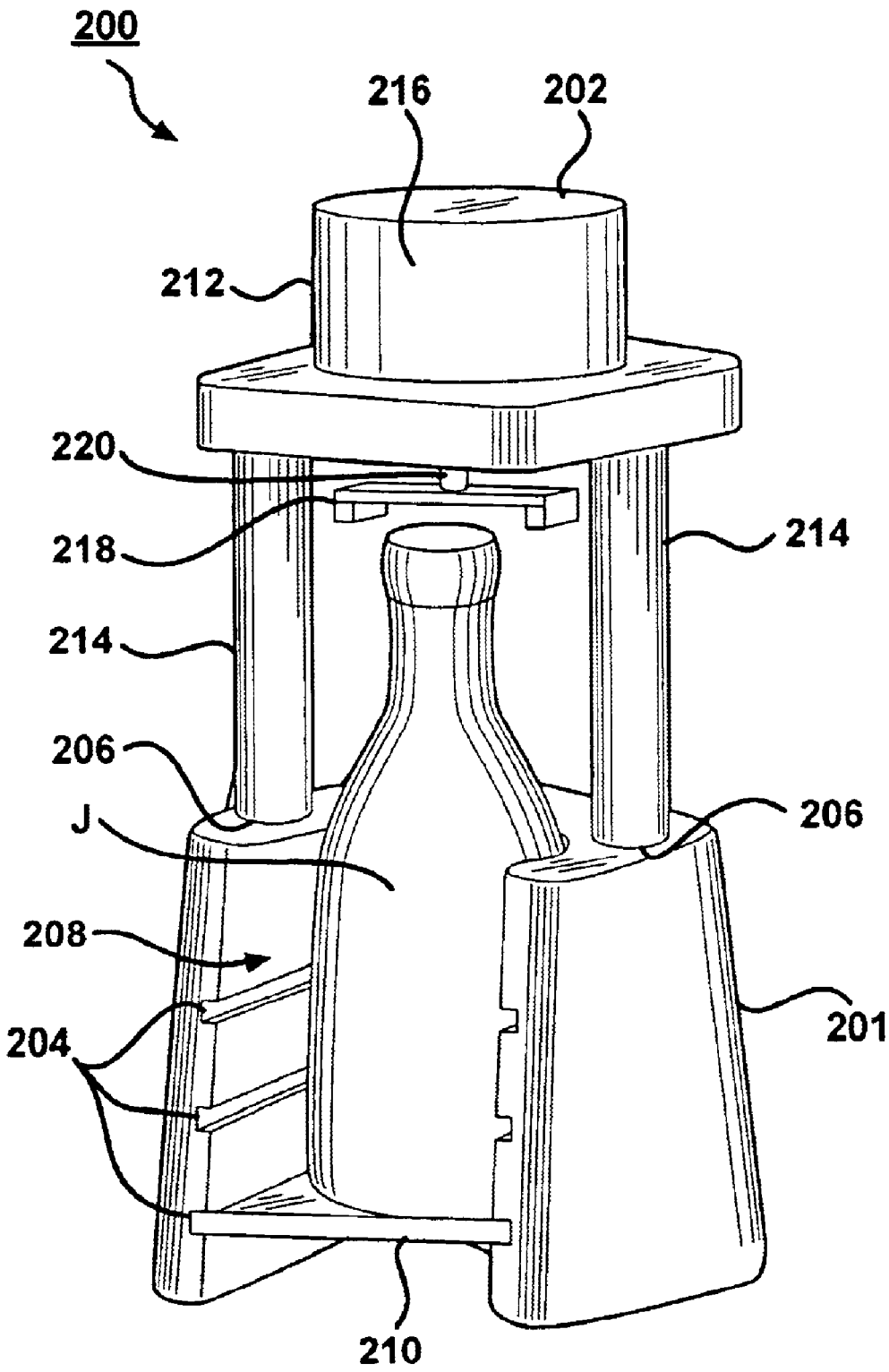
FIG. 9 is a perspective view of an alternate embodiment of the present invention.

Referring also to FIG. 9, there is shown a perspective view of another alternate embodiment of the present invention. In this embodiment, the opener 200 comprises a lower frame section 201 and an upper frame section 202. The lower frame section 201 generally comprises slots 204, holes 206 and a receiving area 208. The receiving area 208 is generally adapted to receive the jar base of the jar J. The slots 204 are located at the receiving area 208. The holes 206 extend downward into the bottom frame section from the top surface of the frame section. The bottom frame section 201 could comprise springs (not shown) located in the holes 206. The opener 200 further comprises an adjustable shelf 210. The shelf 210 is adapted to be inserted and removed in the slots 204. The slots 204 are vertically spaced from each other in the receiving area 208. Thus, the adjustable shelf 210 can be located at different heights in the receiving area 208.

The top frame section 202 general comprises a main section 212 and two posts 214. The two post 214 are slidably located in the holes 206. The two post 214 are preferably biased in an upward position by the springs in the bottom frame section 201. However, in alternate embodiments, the springs might not be provided. A motor 216 is located in the main section 212. A lid clamp assembly 218 is connected to the motor 216 by a rotatable shaft 220. The gripping power to the lid of the jar is powered by the motor, which provides the rotational power needed to twist off the lid. The shelf 210 preferably comprises a non-slip base which can provide the counter rotational force. These three elements together allow the user to open a jar with very little effort.

The architecture of the product could be adapted to accommodate jars within a specified size range of about 1 in. to about 10 in. in height, about 1 in. to about 4.5 in. in diameter, and a lid diameter of about one half inch to about 2 in. in diameter. The base of the unit could be adjustable to accommodate the different types of different jars. By adjusting the shelf up or down, the size of the jar can range from about 10 in. to about 1 in. in height. The motor and the gear drive can be located in the top of the unit which helps with downward pressure. The on/off switch can also be located on the top of the unit. The top half of the unit can be spring loaded to keep it up. If a user wants to store the unit, it can be pushed down and locked in place. In an alternate embodiment, the motor and lid clamp could be removable such that they could be used separate from the bottom frame section for opening larger bottles or jars.

One of the objects of the present invention is to break the seal between a jar and a lid so a user can remove the lid with a minimum amount of effort. With the present invention, the unit can be powered by a motor that turns an upper jaw assembly which can rest against a top of the lid of the jar. The upper jaw assembly can start to turn the jaws inward towards the lid as the upper jaw assembly is rotated. This is accomplished by the weight of the unit above the jar and the friction applied by a portion of the upper jaw assembly, such as rubber or another material.

Once the jaws of the upper jaw assembly grip the lid, the jar can start to spin on a lower jaw assembly. The lower jaw assembly can clamp the base of the jar just like the upper jaw assembly clamped the lid of the jar. Once the base of the jar is gripped, the jar stops spinning. A torque is then applied to the lid via the motor and upper jaw assembly and the lid is screwed off of the base of the jar.

Other variations on the design could comprise removal of the top frame section, motor and upper jaw assembly from the base of the frame and the ability to use the motor separately from the bottom frame section for opening larger bottles or jars.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed:

1. A jar opener comprising:

a lid clamp adapted to clamp onto a lid of a jar;

a motor connected to the lid clamp;

a frame having the motor connected thereto, the frame comprising at least three frame sections which are vertically slidingly connected relative to one another in series in a general telescoping fashion, wherein the motor is connected to a top one of the frame sections; and at least one spring biasing a middle one of the frame sections in an upward direction relative to a bottom one of the frame sections.

2. A jar opener as in claim 1 further comprising a latching system for latching the middle frame section in a downward position on the bottom frame section with the spring being compressed therebetween.

3. A jar opener as in claim 1 wherein the top frame section is located directly against the middle frame section in a downward position by gravity, and the top frame section can be moved upward relative to the middle frame section by a user pulling upward on the top frame section.

4. A jar opener comprising:

a lid clamp adapted to clamp onto a lid of a jar;

a motor connected to the lid clamp; and a frame having the motor connected thereto, the frame comprising at least three frame sections which are vertically slidingly connected relative to one another in series in a general telescoping fashion, wherein the motor is connected to a top one of the frame sections;

wherein the top frame section comprises two downwardly extending posts slidably extending into holes in a middle one of the frame sections, and at least one of the two downwardly extending posts comprise a latching surface for latching the top frame section in a downward position with a bottom one of the frame sections.

5. A jar opener comprising:

a lid clamp adapted to clamp onto a lid of a jar;

a motor connected to the lid clamp;

a frame having the motor connected thereto, the frame comprising at least three frame sections which are vertically slidingly connected relative to one another in series in a general telescoping fashion, wherein the motor is connected to a top one of the frame sections; and an adjustable clamp connected to the frame opposite the lid clamp, the adjustable clamp comprising a stationary gear and at least two jaw members having teeth intermeshed with teeth of the stationary gear.

6. A jar opener comprising:

a lid clamp adapted to clamp onto a lid of a jar;

a motor connected to the lid clamp;

a frame comprising at least two frame sections vertically slidingly connected to each other, a top one of the frame sections having the motor connected thereto; and at least one spring located between portions of the frame sections for biasing the top frame section and the motor in an upward direction.

7. A jar opener as in claim 6 further comprising a latching system for latching the at least two frame sections to one another in a compacted closed position.

8. A jar opener as in claim 6 wherein the frame comprises three frame sections vertically slidingly connected to each other.

9. A jar opener as in claim 6 wherein the frame comprises an adjustable jar bottom surface support platform which can be moved vertically up and down relative to one of the frame sections.

10. A jar opener as in claim 6 wherein a bottom one of the frame sections comprises upwardly extending posts on opposite lateral sides of the bottom section, and the top frame section comprises downwardly extending posts slidably connected to the upwardly extending posts.

11. A jar opener as in claim 10 wherein the upwardly extending posts are concentrically located relative to respective downwardly extending posts.

12. A jar opener as in claim 6 wherein the jar opener comprises two of the springs, each of the two springs being located on opposite lateral sides of the frame.

13. A jar opener comprising:

a frame;

a motor connected to the frame;

a first adjustable clamp connected to the motor; and a second adjustable clamp connected to the frame, wherein the second adjustable clamp comprises a stationary gear and at least two second jaw members having teeth intermeshed with teeth of the stationary gear, and wherein the second jaw members are adapted to rotate about the stationary gear to move clamping surfaces of the second jaw members inward and outward relative to the stationary gear.

14. A jar opener as in claim 13 wherein the first adjustable clamp comprises a rotatable gear connected to the motor and at least two first jaw members having teeth intermeshed with teeth of the rotatable gear.

15. A jar opener as in claim 14 wherein the two first jaw members are rotatable about the rotatable gear.

16. A jar opener as in claim 15 wherein the first adjustable clamp further comprises at least one spring biasing the first jaw members in outward directions relative to each other.

17. A jar opener as in claim 13 wherein the frame comprises at least three frame sections which are vertically slidingly connected relative to one another in series in a general telescoping fashion, and wherein the motor is connected to a top one of the frame sections.

18. A jar opener as in claim 17 further comprising at least one spring biasing a middle one of the name sections in an upward direction relative to a bottom one of the frame sections.

19. A jar opener as in claim 13 wherein the first adjustable clamp comprises a magnet.

20. A jar opener as in claim 13 wherein the first and second adjustable clamps are located directly opposite each other, form a jar receiving area therebetween, and are located at top and bottom sides of the jar receiving area.

21. A jar opener as in claim 13 wherein the second adjustable clamp further comprises at least one spring for biasing the second jaw members in outward directions relative to each other.

22. A jar opener comprising:

a name;

a motor connected to the frame; and a clamping system connected to the frame and the motor, the clamping system comprising a first jar engagement assembly connected to the motor and a second jar engagement assembly connected to the frame, wherein the second jar engagement assembly comprises generally opposing jaw members adapted to be moved to a clamping position onto a jar by rotational movement of the second jaw assembly, transmitted to the second jaw assembly by the jar, while the jar is rotated on the second jaw assembly.

23. A jar opener as in claim 22 wherein the second jar engagement assembly generally comprises a stationary gear which is stationarily connected to the frame, and at least two jaw members connected to the stationary gear for rotation about the stationary gear to move clamping surfaces of the jaw members inward and outward relative to the stationary gear.

24. A jar opener as in claim 23 wherein the second jar engagement assembly comprises at least one spring for biasing the two jaw members in outward directions relative to each other.

25. A method for opening a jar in a motorized jar opening apparatus comprising steps of:

rotating the jar; and automatically closing a jar clamp onto the jar as the jar is rotated, the step of automatically closing comprising the jar clamp being axially rotated by contact with the rotating jar to move clamping surfaces of jaw members of the jar clamp inward towards each other;

wherein the jar clamp comprises a gear stationarily connected to a frame of the jar opening apparatus and the jaw members are rotatably connected to the gear, wherein the jaw members move inward relative to the stationary gear when the jaw members are rotated about the gear.

26. A method for opening a jar in a motorized jar opening apparatus comprising steps of:

rotating the jar;

automatically closing a jar clamp onto the jar as the jar is rotated, the step of automatically closing comprising the jar clamp being axially rotated by contact with the rotating jar to move clamping surfaces of jaw members of the jar clamp inward towards each other;

locating a lid clamp of the jar opening apparatus against a lid of the jar; and rotating the lid clamp while the lid clamp is located against the lid, the lid clamp clamping onto the lid as the lid clamp is rotated relative to the lid, wherein the jar is rotated by a motor of the jar opening apparatus only after the lid clamp clamps onto the lid of the jar.

27. A method for opening a jar in a motorized jar opening apparatus comprising steps of:

rotating, the jar;

automatically closing a jar clamp onto the jar as the jar is rotated, the step of automatically closing comprising the jar clamp being axially rotated by contact with the rotating jar to move clamping surfaces of jaw members of the jar clamp inward towards each other; and opening a frame of the jar opening apparatus from a closed position to an at least partially open position, the step of opening the frame comprising a spring moving at least two frame sections vertically apart from each other.

28. A method as in claim 27 wherein the step of opening the frame further comprises manually lifting a top one of the frame sections to an up position relative to a lower one of the frame sections, the top section having a motor therein.

29. A method as in claim 28 further comprising pushing downward on the top frame section to press a lid clamp of the jar opening apparatus against a lid of the jar, wherein weight of the motor helps to press the lid clamp against the lid.

30. A method for opening a jar in a motorized jar opening apparatus comprising steps of:

rotating a first jar engagement assembly by a motor while the jar remains relatively stationary, the first jar engagement assembly being located against a first portion of the jar;

closing the first jar engagement assembly onto the first portion of the jar as the first jar engagement assembly is rotated relative to the first portion;

subsequently rotating the first jar engagement assembly and the jar together as a unit; and automatically moving a second jar engagement assembly from an open position to a closed position onto a second portion of the jar as the jar is rotated, the second jar engagement assembly being located against the second portion and being moved to the closed position by rotation of the jar.

* * * * *